US006044730A

United States Patent [19]

Roberts et al.

[11] Patent Number: 6,044,730

[45] Date of Patent: Apr. 4, 2000

[54] RATCHET WRENCH

[75] Inventors: Peter M. Roberts, Red Bank, Tenn.; John B. Davidson, Chicago, Ill.

[73] Assignee: JODA Enterprises, Inc., Chicago, Ill.

[21] Appl. No.: 09/144,532

[22] Filed: Aug. 31, 1998

Related U.S. Application Data

[60] Provisional application No. 60/062,671, Oct. 8, 1997, and provisional application No. 60/081,207, Apr. 9, 1998.

[51] Int. Cl.[7] ..... B25B 13/46

[52] U.S. Cl. ..... 81/63; 81/177.85

[58] Field of Search ..... 81/59.1, 60–63, 81/63.1, 63.2, 177.85

*Primary Examiner*—D. S. Meislin
*Attorney, Agent, or Firm*—Brinks Hofer Gilson & Lione

[57] ABSTRACT

A ratchet wrench including a handle, a drive stud, and a ratchet mechanism further includes a tool release mechanism. The tool release mechanism includes a tool release actuator which forms a recess. A reversing lever is coupled to the ratchet mechanism and is movable to forward, non-ratcheting and reverse positions to select a forward ratchet direction, a non-ratcheting action, and a reverse ratchet direction, respectively, for the ratchet mechanism. The direction control element carries a protruding element that is shaped to fit into a recess in the tool release actuator when the direction control element is in the forward position, to remain outside the recess when the direction control element is in the non-ratcheting position, and to fit into the recess when the direction control element is in the reverse position. The protruding element impedes inadvertent operation of the tool release mechanism when the direction control mechanism is in either the forward or the reverse positions. The direction control element can be mounted internally or externally of the wrench, and the ratchet wheel of the ratchet mechanism can be centered by a protruding element formed on an inner surface of the handle and sized to slide within an annular recess of the ratchet wheel.

44 Claims, 4 Drawing Sheets

RATCHET WRENCH

This application is related to provisional application Ser. Nos. 60/062,671 filed Oct. 8, 1997 and 60/081,207 filed Apr. 9, 1998.

BACKGROUND

The present invention relates to ratchet wrenches such as socket wrenches, and in particular to ratchet wrenches with improved tool release mechanisms that resist inadvertent operation and to ratchet wrenches with improved direction control of the ratchet mechanism.

U.S. Pat. No. 3,208,318 discloses an effective tool release mechanism for tools such as sockets. In the disclosed system a control rod is axially slidable in a drive stud of the wrench, and the control rod defines a ramp surface on which a ball rides. A spring biases the control rod outwardly to a rest position, in which the ball positively engages an accommodating recess in a tool such as a socket. When it is desired to release the socket from the drive stud, the control rod is depressed against the biasing force of the spring, thereby allowing the ball to move down the ramp to a position which allows removal of the socket.

The tool release mechanism of the above-identified patent has been found to be reliable and effective in use. However, the possibility exists that under some circumstances a user may inadvertently depress the control rod while using the wrench. This may happen for example if the head of the wrench is placed in the palm of the user's hand. In this case the palm of the user's hand can come into contact with the upper end of the control rod, and can inadvertently depress the control rod while the wrench is in use, thereby inadvertently releasing the socket. One object of the embodiment described below is to overcome this potential drawback of the prior art.

Roberts U.S. Pat. No. 4,420,995 discloses a tool release mechanism for tools such as sockets. In the disclosed ratchet mechanism a ratchet wheel is provided with an annular raised boss on the side of the ratchet wheel opposite the drive stud, and this boss fits within a recess in the head of the wrench. The boss resists forces tending to decenter the ratchet wheel with respect to its axis of rotation.

Conventional ratchet wrenches are provided with only two stable positions of the ratchet mechanism: forward and reverse. This can represent a limitation in some situations.

SUMMARY

The present invention is defined by the following claims, and nothing in this section should be taken as a limitation on those claims. By way of introduction, the embodiments described below provide a mechanical interlock between the direction control element and the tool release mechanism of a ratchet wrench. The direction control element is coupled to the ratchet mechanism of the wrench to select a ratchet direction for the ratchet mechanism. For example, the direction control element can move from a first position to select a forward (tightening) direction, to a second position to select a non-ratcheting (e.g. free-wheeling or non-rotating) action, to a third position to select a reverse (loosening) direction for the ratchet mechanism. The direction control element is coupled to the tool release mechanism such that inadvertent operation of the tool release mechanism is impeded when the direction control element is in the first or third ranges of positions to select either the forward or the reverse direction. It is only when the direction control element is in the second range of positions to select the non-ratcheting action that the ratchet control mechanism can readily be used to release a socket.

Many alternative mechanical arrangements can be used to perform these functions, as described below. For example, the coupling between the direction control element and the tool release mechanism can be positioned externally or internally of the wrench handle. If desired, the ratchet wheel of the ratchet mechanism may include an annular recess on a face of the ratchet wheel opposite the drive stud. The handle of the wrench can include a protruding centering element that extends into the recess of the ratchet wheel to center the ratchet wheel.

DETAILED DESCRIPTION OF THE PRESENTLY PREFERRED EMBODIMENTS

Figure 1:
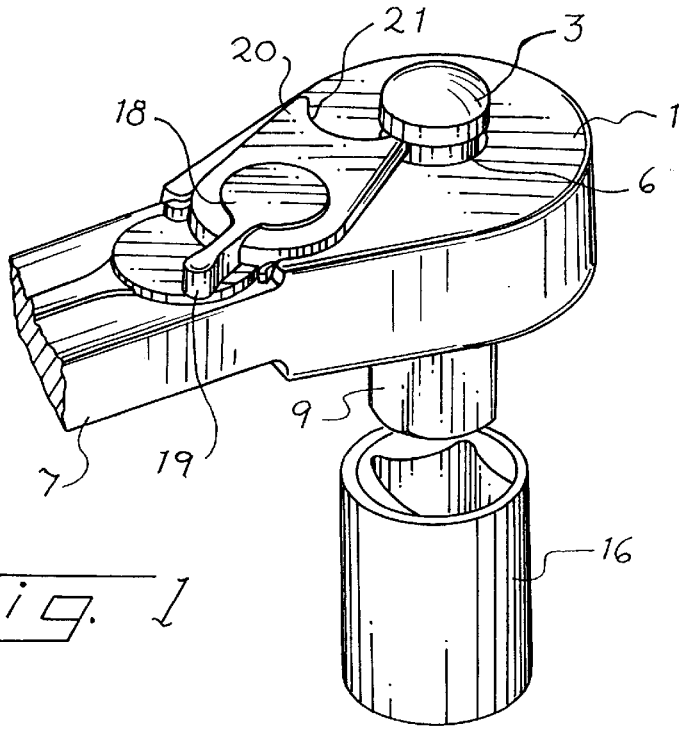
FIG. 1 is a perspective view of a ratchet wrench that incorporates a presently preferred embodiment of this invention.
Figure 5:
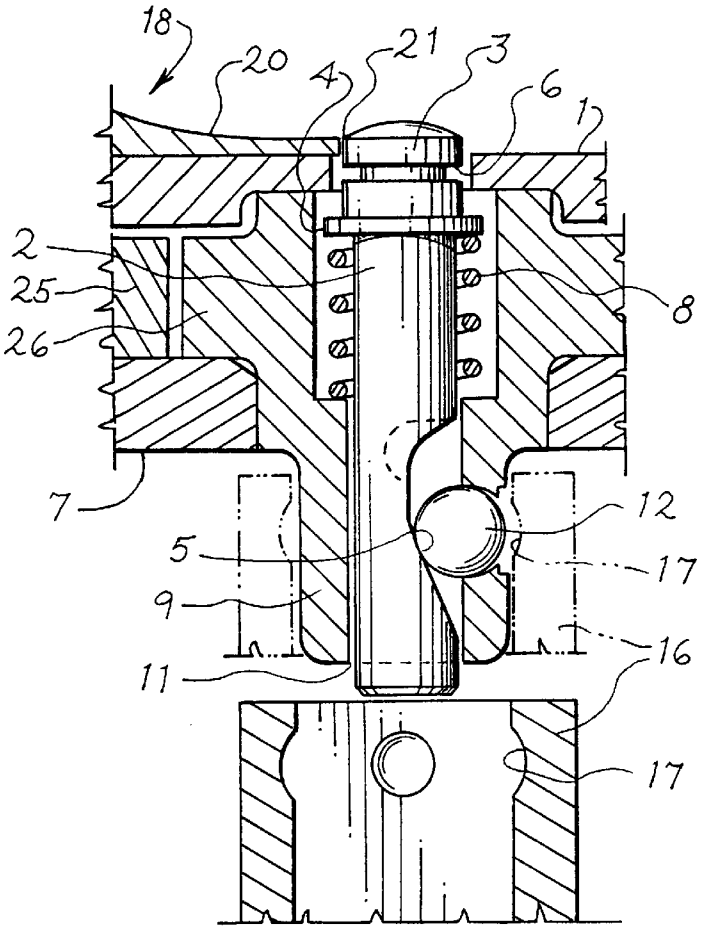
FIG. 5 is a cross-sectional view taken along line 5—5 of FIG. 2.

Turning now to the drawings, FIG. 1 shows a perspective view of a ratchet wrench 1 that incorporates a preferred embodiment of this invention. The ratchet wrench 1 includes a handle 7 that supports a drive stud 9 for rotation. A ratchet mechanism (not shown in FIG. 1) controls rotation of the drive stud 9 with respect to the handle 7. The drive stud 9 is shaped and dimensioned to be received by an out-of-round female opening in a tool such as a socket 16. As best shown in FIG. 5, the drive stud 9 carries a control rod 2 that slides within a bore 11. In alternative embodiments, the control rod 2 may protrude from the drive stud 9 in certain positions, as shown in FIG. 5, or the control rod 2 may remain within the drive stud 9 throughout its range of travel. The control rod 2 defines a head 3, an annular recess 6, and a flange 4. A spring 8 bears between the flange 4 and a shoulder on the bore 11 to bias the control rod 2 upwardly in the orientation shown in FIG. 5.

Figure 6:
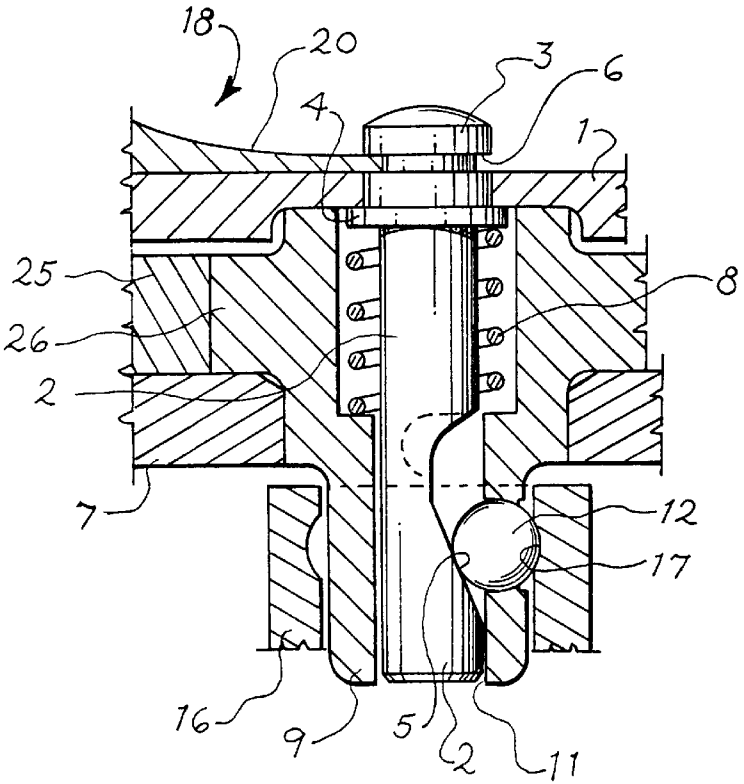
FIG. 6 is a cross-sectional view taken along line 6—6 of FIG. 3.

The control rod 2 also defines a ramp 5 that bears against the ball 12. When the ball 12 is positioned at a more recessed portion of the ramp 5, the ball 12 can move entirely inside the drive stud 9 to allow a socket 16 to be inserted on and removed from the drive stud 9. See FIG. 5. Conversely, when the control rod 2 is biased to an outer position as shown in FIG. 6, the ball 12 rests on a less recessed portion of the ramp 5, and the ball 12 protrudes partly out of the drive stud 9 into a recess 17 in the socket 16. In this way the ball 12 positively retains the socket 16 on the drive stud 9. The control rod 2 can be taken as an example of a tool release actuator and the ball 12 can be taken as an example of a tool retention element. The control rod 2 and the ramp 5 may provide selective alignment of the ball 12 for each individual socket 16.

Returning to FIG. 1, the wrench 1 also includes a reversing lever 18 that is coupled with a pawl 25 and can be used to control the ratchet mechanism of the wrench 1. The reversing lever 18 includes a handle 19 and a flange 20. The flange 20 defines a centrally positioned cutout 21 that is generally shaped as a portion of a circle in this embodiment. Alternatively, the cutout 21 may be shaped otherwise while functioning as described below to selectively allow movement of the head 3.

Figure 2:
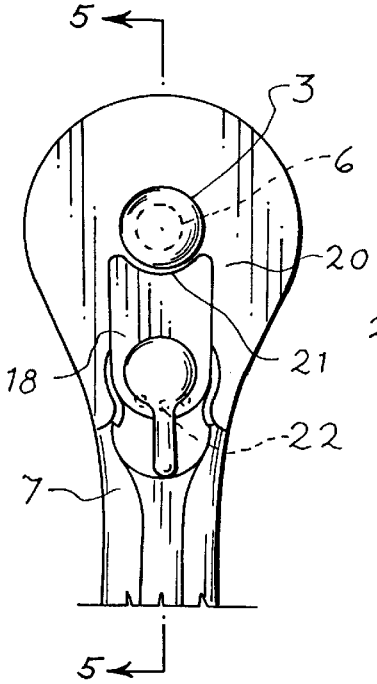
FIGS. 2, 3 and 4 are top views of the ratchet wrench of FIG. 1 showing the direction control element positioned to select the non-ratcheting action and the forward and reverse directions, respectively, of the ratchet mechanism.

As best shown in FIGS. 2 and 5, when the reversing lever 18 is positioned to select a non-ratcheting action, the cutout 21 is centered on the head 3, and no part of the flange 20 is positioned inside the recess 6. As shown in FIG. 5, with the flange 20 in this position, pressure on the head 3 can be used to depress the control rod 2 against the biasing force of the spring 8, thereby allowing the ball 12 to move entirely within the drive stud 9. In this position the socket 16 can be inserted onto the drive stud 9 and removed from the drive stud 9. When the reversing lever 18 is in the non-ratcheting position of FIGS. 2 and 5, the reversing lever 18 positions a pawl 25 carried in the handle 7 to a neutral position, in which it is out of engagement with the ratchet wheel 26. In this neutral position the drive stud 9 is not controlled with a ratcheting action. For example, the drive stud may be left free to rotate in either the forward or the reverse direction with respect to the handle 7, or the drive stud may be locked.

Figure 3:
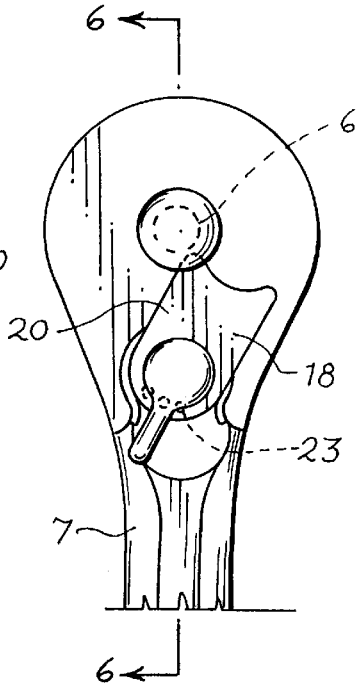

As shown in FIGS. 3 and 6, the reversing lever 18 may be moved to the forward position, in which the flange 20 fits within the groove 6 and the pawl 25 is brought into engagement with a ratchet wheel 26 that is coupled for rotation with the drive stud 9. In this forward position the flange 20 is mechanically interlocked with the control rod 2 such that axial movement of the control rod 2 is prevented. Since the control rod 2 cannot move downwardly into the wrench 1, the ball 12 is maintained in an outer position, and the socket 16 is positively retained in place on the drive stud 9. In this forward position of the reversing lever 18, forward rotation of the handle 7 is transferred to the drive stud 9 while the reverse rotation of the handle 7 is allowed with respect to the drive stud 9. Ratchet mechanisms including pawls with only two detent positions are well known to those skilled in the art, and are therefore not described in detail here. See for example U.S. Pat. Nos. 5,386,747 (Grover), 5,178,047 (Arnold), and 4,300,413 (Garofalo) for detailed descriptions of suitable ratchet mechanisms.

Figure 4:
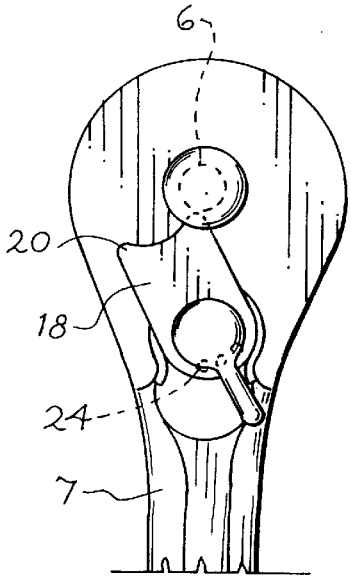

As shown in FIGS. 1 and 4, the reversing lever 18 can also be moved to a reverse position. In the reverse position the flange 20 is again received within the recess 6 to prevent axial movement of the control rod 2, and the pawl 25 is positioned against the ratchet wheel 26 to transfer reverse rotation of the handle 7 to the drive stud 9 while allowing forward rotation of the handle 7 relative to the drive stud 9.

One preferred embodiment provides a detent mechanism, which may be constructed as shown schematically in FIGS. 2–4. The detent mechanism includes a non-ratcheting (or neutral) detent recess 22 (FIG. 2) which cooperates with a spring loaded ball (not shown) to create forces that tend to retain the reversing lever 18 in the non-ratcheting position. The detent mechanism may also include a forward detent recess 23 (FIG. 3) and a reverse detent recess 24 (FIG. 4) which cooperate with the detent ball (not shown) to hold the reversing lever 18 in the forward and reverse positions, respectively. The protruding portion of the detent mechanism may be mounted on the reversing lever or the portion of the wrench adjacent to the reversing lever.

From the foregoing detailed description it should be apparent that the reversing lever 18 forms a direction control element having forward, reverse and non-ratcheting positions. This direction control element impedes or prevents inadvertent activation of the tool release mechanism that includes the control rod 2 when the direction control element is in either the forward or reverse position. Normal operation of the tool release mechanism is allowed when the direction control element is in a non-ratcheting position. The flange 20 forms one example of a first protruding element and the head 3 forms one example of a second protruding element. The first and second protruding elements are mechanically interlocked when the direction control element is in the forward and reverse positions, and they are mechanically separated from one another to allow movement of the control rod 2 when the direction control element is in the non-ratcheting position.

The flange 20 and the head 3 cooperate to form a means for coupling the direction control element to the tool release mechanism. Of course, many alternatives are possible. For example, other motions are possible, including sliding rather than pivoting motions for the direction control element. Also, the precise shapes and manner of mechanical interlock can be varied to suit the intended application. For example, it is not required in all embodiments that the recess 6 be provided with facing shoulders on both sides of the recess 6. If desired, the recess 6 can include a shoulder adjacent the head 3, while the opposing shoulder can be eliminated. Of course, the recess 6 does not have to be annular or adjacent to the head, and it may be formed as a notch in one side of the control rod 2 spaced from the head 3, particularly where the control rod 2 need not rotate in use.

Figure 7:
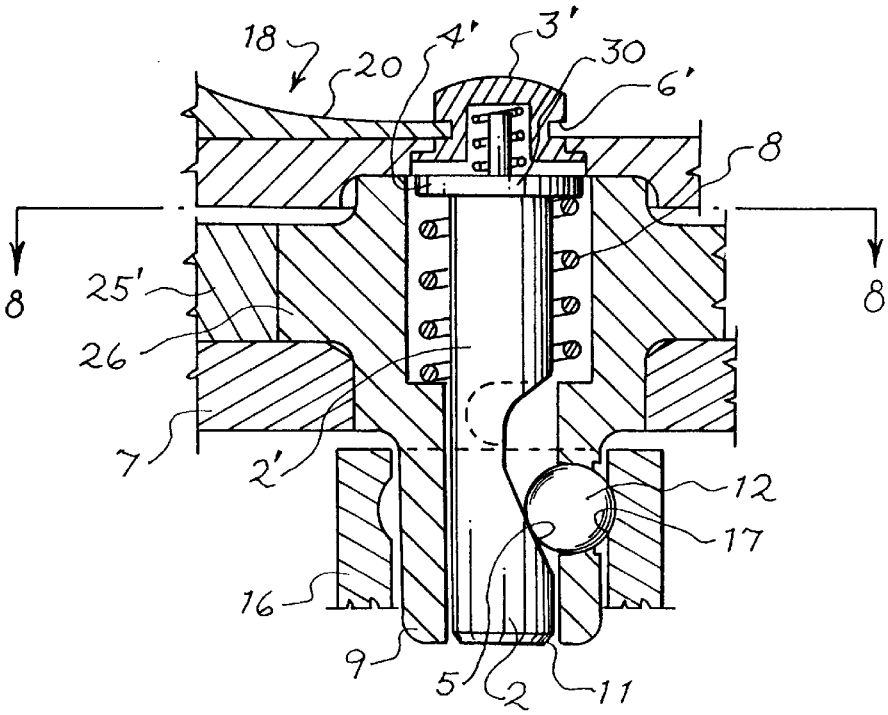
FIG. 7 is a cross-sectional view of a second preferred embodiment.
Figure 8:
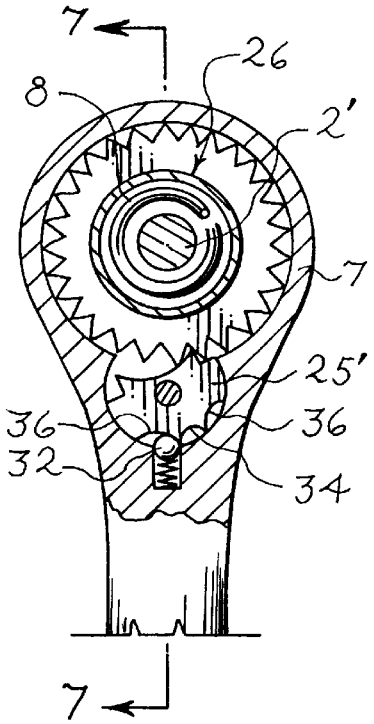
FIG. 8 is a partial cross-sectional view taken along line 8—8 of FIG. 7.

FIGS. 7 and 8 illustrate a second preferred embodiment. In these figures, identical elements are identified with the same reference numerals as those used in FIGS. 1–5. Modified elements are primed in FIGS. 7 and 8.

As shown in FIG. 7, the control rod 2' is formed as a separate part from the button 3'. The control rod 2' is movable in the drive stud 9, and is biased upwardly in the orientation shown in FIG. 7 by the spring 8.

The button 3' includes an annular recess 6' that receives the reversing lever flange 20. The button 3' is free to slide axially in the handle 7 separately from the control rod 2', and a coil spring 30 is interposed between the button 3' and the control rod 2'.

The elements of FIG. 7 cooperate to provide the advantages of the first preferred embodiment discussed above. That is, when the flange 20 of the reversing lever 18 is moved into the recess 6', the button 3' is prevented from moving downwardly in the orientation of FIG. 7, toward the control rod 2'. This positively prevents the button 3' from moving the control rod 2' to release the socket 16. When the reversing lever 18 is moved out of the position shown in FIG. 7 to the forward or the reverse position, the flange 20 is moved out of the recess 6' to allow the button 3' to be used to depress the control rod 2' against the force of the spring 8, thereby releasing the socket 16.

The embodiment of FIG. 7 provides the additional advantage that the control rod 2' is not positively locked in position by the flange 20 of the reversing lever 18 when the flange 20 is in the position of FIG. 7. Instead, the control rod 2' remains free to move upwardly in the orientation of FIG. 7 under the force of the spring 8 to bias the ball 12 outwardly. Because the rest position of the control rod 2' is not dictated by the flange 20, the control rod 2' can come to rest in varying axial positions as appropriate for varying sockets 16. This may provide an added measure of positive retention force and selective alignment, even in the face of dimensional variations in sockets 16 and recesses 17. If the ramp of the control rod 2' is suitably shaped, a socket can be pushed onto the drive stud without manual operation of the button 3'.

In view of the foregoing discussion, it should be apparent that the recess defining element (in this case the button 3') only needs to be operationally coupled to the control rod 2'. The two parts 3' and 2' can be separately formed, and can be allowed independent motion, as long as they are operationally coupled to provide the functions described above.

As shown in FIG. 8, this embodiment provides a detent ball 32 that acts in cooperation with recesses 34, 36 formed in the pawl 25'. In FIG. 8, the detent ball 32 is positioned in one of the recesses 36 used to hold the pawl 25 in either the forward or the reverse position. In this position the button 3' is not free to displace the pin 2'. A central recess 34 is provided which cooperates with the detent ball 32 to releasably hold the pawl 25 (and therefore the reversing lever) in an intermediate, non-ratcheting position in which the pawl 25 is out of contact with the ratchet wheel 26, and ratchet wheel 26 is free to rotate without any ratcheting action. In this position, the button 3' is free to move downwardly to displace the pin 2'. Alternately, the pawl may be shaped to be in stable equilibrium at the non-ratcheting position (for example, with a suitably positioned flat) and the detent for the non-ratcheting position can be deleted. If desired, friction can be applied to hold the pawl in the non-ratcheting position.

Figures 9, 10, 11:
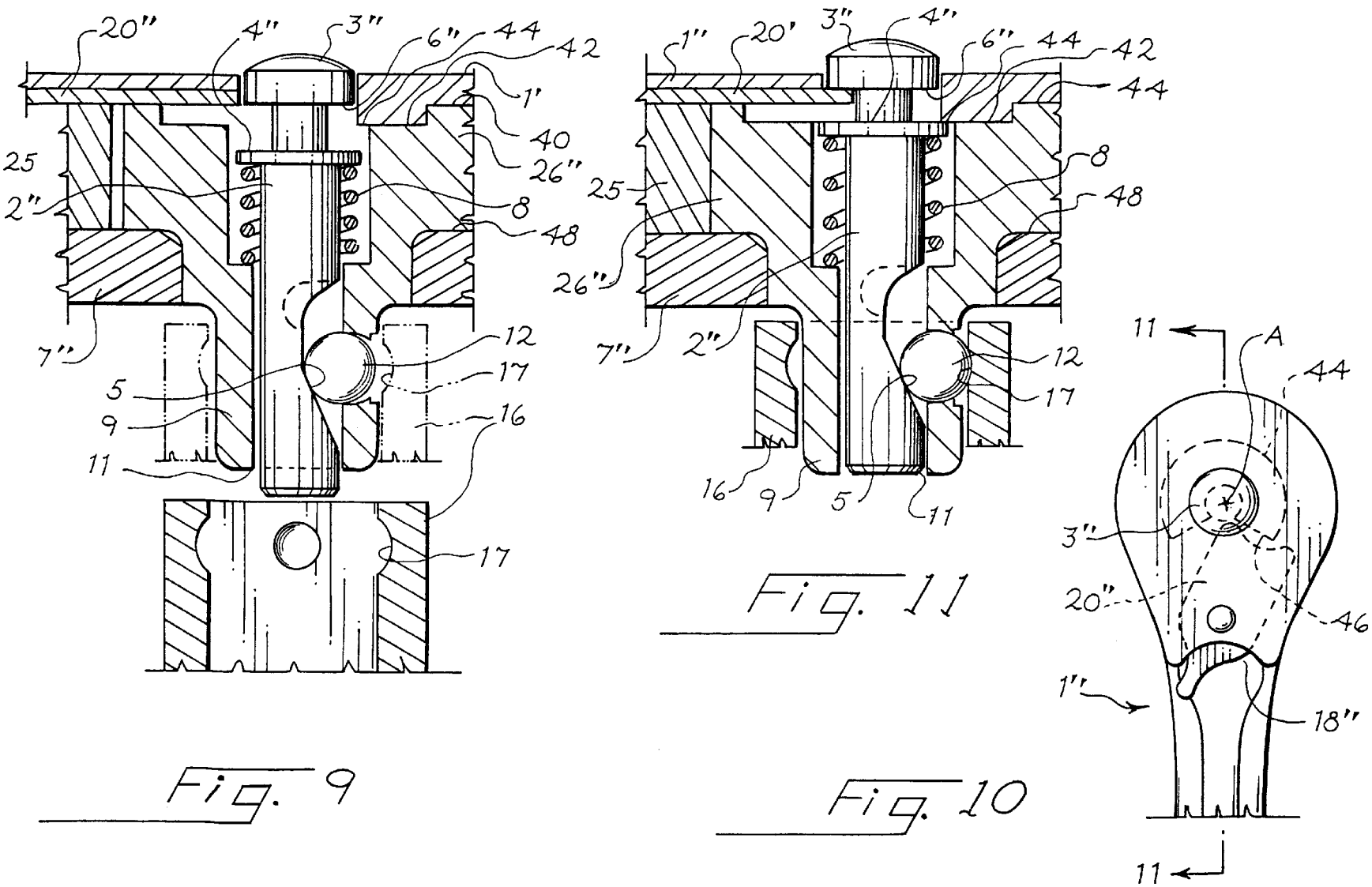
FIG. 9 is a cross-sectional view of a third preferred embodiment of this invention.
FIG. 10 is a top view of the ratchet wrench of FIG. 9 showing the direction control element positioned to select the forward direction of the ratchet mechanism.
FIG. 11 is a cross-sectional view taken along line 11—11 of FIG. 10.

FIGS. 9–11 illustrate a third preferred embodiment. In these figures identical elements as those described above are identified with the same reference numerals. Modified elements are indicated with a double prime symbol in FIGS. 9–11.

As shown in FIG. 9, the control rod 2" includes an integrally formed flange 4", an integrally formed head 3" and an annular recess 6" therebetween. In this case the portion of the reversing lever 18" that engages the head 3" is mounted internally of the handle 7", as shown in the dotted line representation of FIG. 10. The reversing lever 18" includes a flange 20" shaped to fit into the annular recess 6" when the reversing lever 18" is in either the forward or the reverse position, and to remain outside of the annular recess 6" when the reversing lever 18" is in the neutral position.

FIG. 9 shows the flange 20" when the reversing lever is in the neutral position. In this position the flange 20" is positioned to allow the control rod 2" to be depressed by manual pressure on the head 3" as described above. As shown in FIG. 11, when the reversing lever is in either the forward or the reverse position, the flange 20" is received in the annular recess 6", thereby preventing downward movement of the head 3" and the control rod 2". As explained above, this prevents inadvertent operation of the tool release mechanism that includes the control rod 2".

If desired, the ratchet wrench 1" can be provided with a centering element 44 extending from the handle 7" toward the ratchet wheel 26". As shown in FIGS. 9 and 11, ratchet wheel 26" includes a face 40 opposite the drive stud 9, and this face 40 defines a first recess 42. The first recess 42 is annular, and is positioned and dimensioned to receive the centering element 44. The ratchet wheel 26" rotates in a recess 48 formed in the handle 7".

As shown in FIG. 10, the centering element 44 can be shaped to extend partly around the axis A about which the ratchet wheel rotates. As shown in FIG. 10, the centering element 44 can include a gap 46 positioned to allow passage of the flange 20" as described above. In FIG. 10 the centering element 44 extends around the axis A through an arc of about 270°.

The purpose of the centering element 44 is to center the ratchet wheel 26" against yawing movement of the ratchet wheel 26" away from the pawl 25 that would interfere with effective engagement between the ratchet wheel 26" and the pawl 25. With this arrangement centering forces are applied to the ratchet wheel 26" both adjacent the face 40 and adjacent the drive stud 9, thereby providing excellent strength characteristics. Though not required, the centering element 44 may be configured also to center the ratchet wheel 26" against movement toward the pawl 25 and/or along an axis extending transversely to a line extending between the axis A and the pawl 25.

It should be understood that the centering element 44, though desirable, is not required in all embodiments. If reduced centering forces are acceptable, the face 40 can simply be formed as an unrecessed plane and the centering element 44 can be eliminated.

The centering element 44 is not required to couple to the ratchet wheel in a continuous bearing surface, and the centering element 44 can be formed of one or more elements that form a plurality of bearing surfaces engaging the ratchet wheel and separated by one or more gaps.

The internally mounted reversing lever of FIGS. 9–11 can readily be adapted for use with embodiments having separate buttons 3' and control rods 2' as shown in FIG. 7.

The invention is not limited to the particular tool release mechanisms and ratchet mechanisms described above. Any suitable tool release mechanism and ratchet mechanism can be used. Furthermore, the wrench can take any suitable form, and the invention is not limited to use with sockets. Rather, the invention can be used with tool release mechanisms for any suitable tool, including extension bars, universal joints, bits and numerous other tools. The drive stud can take any suitable shape, and is not required to be square in all embodiments. Other out-of-round shapes suitable for transmitting torque by mating with a female cavity in a driven element can be used, including hexagonal shapes, for example. The quick release mechanism can be formed without a control rod of the type described above, and many other mechanical alternatives are possible.

Figure 12:
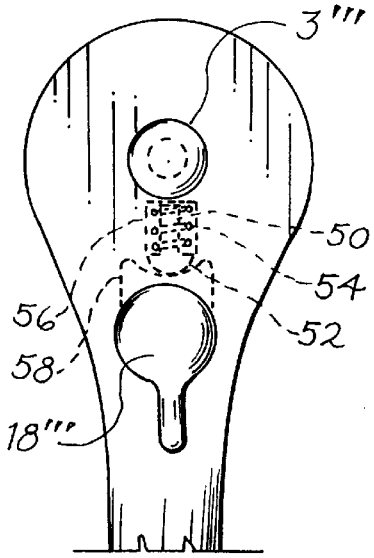
FIG. 12 is a top view of a ratchet wrench that incorporates a fourth preferred embodiment of this invention.

Many other alternatives are possible. For example, the protruding elements discussed above may be (1) integrally formed with, or (2) separately formed from and attached to or functionally coupled to the associated components. One separately formed embodiment is shown in FIG. 12. In this embodiment the first protruding element takes the form of a pin 50 that may have an enlarged head 52 and is biased by a spring 54 for movement in a bore 56 toward the reversing lever 18"'. The reversing lever 18"' includes a ramp or cam 58 oriented to contact the enlarged head 52. When the reversing lever 18"' is in the neutral position shown in FIG. 12, the cam 58 allows the pin 52 to move under the biasing force of the spring 54 out of interlocking engagement with the head 3'''. When the reversing lever 18''' is moved to any other position (including the forward and reverse ratcheting positions), the cam 58 pushes the pin 50 against the biasing force of the spring 54 into interlocking engagement with the head 3'''. The elements 50 through 58 are shown in dotted lines in FIG. 12 because they are mounted internally of the wrench and are not visible in the top view of FIG. 12. It should be understood that the spring 54 can easily be eliminated. For example, the head 3''' may be shaped to displace the pin 50 when pressure is applied to move the head 3''' downwardly and the cam 58 is positioned to allow such motion.

For convenience of reference, the direction control element will be said to include the first protruding element both when the direction control element is integrally formed with the first protruding element and when the first protruding element is formed separately from the reversing lever but functionally engaged with it.

Also, the protruding element may be attached to or otherwise coupled with the pawl instead of the reversing lever, and it should be understood that the term "direction control element" is intended broadly to encompass both the reversing lever and the pawl of the embodiments described above.

Figure 13:
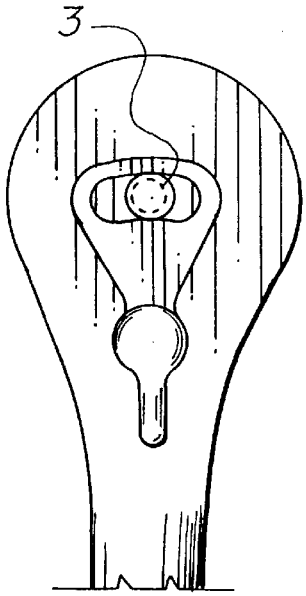
FIG. 13 is a top view of a ratchet wrench that incorporates a fifth preferred embodiment of this invention.

Furthermore, the protruding element associated with the direction control element may protrude to one side of the control rod. In some alternative embodiments (FIG. 13), the first protruding element may include a plate having an aperture through which the head 3 passes. In this case, the first protruding element will not extend to the outer periphery of the plate.

The protruding element associated with the quick release mechanism does not have to be formed by an annular recess, or even by a recess. Where it is desired to include an additional detent function, any of a variety of detent mechanisms, including those described above, can be used.

As used herein the following terms are used as indicated. The term "tool release actuator" is intended to encompass all portions of a tool release mechanism up to the tool retention element, including the control rod 2 and the button 3'. Thus, the direction control element may be mechanically interlocked with the tool release actuator at a point remote from the head that is manipulated by the user. The tool retention element may if desired be integrally formed with the tool release actuator. The ramp 5 may be linear, curved or stepped, and may be formed by a ball bearing in some alternatives.

The term "coupled" is intended broadly to encompass both direct and indirect coupling. Thus, first and second parts are said to be coupled together when they are directly functionally engaged (e.g. by direct contact), as well as when the first part is functionally engaged with an intermediate part which is functionally engaged either directly or via one or more additional intermediate parts with the second part. Also, two elements are said to be coupled when they are functionally engaged (directly or indirectly) at some times and not functionally engaged at other times.

The term "ratchet direction" is intended broadly to include at least the forward and reverse ratchet functions and the non-ratcheting or neutral ratchet function described above. Thus, a ratcheting action is not required for ratchet directions such as the non-ratcheting or neutral ratchet direction, which may by way of example and not limitation be freely rotatable, rotatable against a frictional load, or locked.

The term "position" is intended broadly to encompass a range of positions.

The term "tool release mechanism" is intended broadly to encompass mechanisms that selectively reduce tool retention forces, even if they are not entirely eliminated.

The term "mechanical interlock" is intended broadly to encompass mechanical engagement that limits motion of one of the parts in at least one direction.

The term "detent mechanism" is intended broadly to encompass any system for biasing a first element into one or more selected positions with respect to a second element, whether or not the mechanism includes a detent ball.

The foregoing detailed description has described only a few of the many forms that the present invention can take, and should therefore be taken as illustrative rather than limiting. It is only the following claims, including all equivalents, that are intended to define the scope of this invention.

We claim:

1. In a ratchet wrench of the type comprising: a handle, a drive stud rotatably mounted in the handle, and a ratchet mechanism coupled to the drive stud, the improvement comprising:

a tool release mechanism comprising a tool retention element disposed in the drive stud and a tool release actuator coupled to the tool retention element;

a direction control element coupled to the ratchet mechanism and movable to a plurality of positions to select respective ratchet directions for the ratchet mechanism;

said direction control element coupled to the tool release actuator to impede inadvertent operation of the tool release mechanism when the direction control element is in at least a selected one of said positions.

2. The invention of claim 1 wherein the plurality of positions comprise a forward position, in which the direction control element controls the ratchet mechanism to transfer forward rotation of the handle to the drive stud while allowing reverse rotation of the handle with respect to the drive stud; a reverse position, in which the direction control element controls the ratchet mechanism to transfer reverse rotation of the handle to the drive stud while allowing forward rotation of the handle with respect to the drive stud; and a non-ratcheting position, in which the direction control element controls the ratchet mechanism to allow forward and reverse rotation of the drive stud in the handle.

3. The invention of claim 2 wherein the direction control element is coupled to the tool release actuator to impede inadvertent operation of the tool release mechanism both when the direction control element is in the forward position and when the direction control element is in the reverse position.

4. The invention of claim 2 wherein the direction control element is coupled to the tool release actuator to allow operation of the tool release mechanism when the direction control element is in the non-ratcheting position.

5. The invention of claim 2 wherein the direction control element is coupled to the tool release actuator to allow operation of the tool release mechanism only when the direction control element is in the non-ratcheting position.

6. In a ratchet wrench of the type comprising: a handle, a drive stud rotatably mounted in the handle, and a ratchet mechanism coupled to the drive stud, the improvement comprising:

a tool release mechanism comprising a tool retention element disposed in the drive stud and a tool release actuator coupled to the tool retention element; and a direction control element coupled to the ratchet mechanism and movable to a plurality of positions to select respective ratchet directions for the ratchet mechanism;

wherein the direction control element comprises a first protruding element, wherein the tool release actuator comprises a second protruding element, and wherein the first and second protruding elements are mechanically interlocked when the direction control element is in at least one of said positions to impede inadvertent operation of the tool release mechanism.

7. The invention of claim 6 wherein the first protruding element is integrally formed with the direction control element.

8. The invention of claim 6 wherein the first protruding element is separately formed from the direction control element.

9. The invention of claim 8 wherein the first protruding element is movable with respect to the direction control element.

10. In a ratchet wrench of the type comprising: a handle, a drive stud rotatably mounted in the handle, and a ratchet mechanism coupled to the drive stud, the improvement comprising:

a tool release mechanism comprising a tool retention element disposed in the drive stud and a tool release actuator coupled to the tool retention element; and a direction control element coupled to the ratchet mechanism and movable to a plurality of positions to select respective ratchet directions for the ratchet mechanism;

wherein the direction control element comprises a first protruding element, wherein the tool release actuator comprises a second protruding element, and wherein the first and second protruding elements are mechanically interlocked both when the direction control element is in the forward position and when the direction control element is in the reverse position.

11. The invention of claim 3 wherein the direction control element comprises a first protruding element, wherein the tool release actuator comprises a second protruding element, and wherein the first and second protruding elements are mechanically disengaged when the direction control element is in the non-ratcheting position.

12. The invention of claim 3 wherein the direction control element comprises a first protruding element, wherein the tool release actuator comprises a second protruding element, and wherein the first and second protruding elements are mechanically disengaged only when the direction control element is in the non-ratcheting position.

13. The invention of claim 6, 7, 8 or 10 wherein the first protruding element is mounted internally of the ratchet wrench.

14. The invention of claim 2, 3, 4, 11 or 12 further comprising a detent mechanism tending to retain the direction control element in the non-ratcheting position.

15. In a ratchet wrench of the type comprising: a handle, a drive stud rotatably mounted in the handle, and a ratchet mechanism coupled to the drive stud, the improvement comprising:

a tool release mechanism comprising a tool retention element disposed in the drive stud and a tool release actuator coupled to the tool retention element;

a direction control element coupled to the ratchet mechanism and movable to a plurality of positions to select respective ratchet directions for the ratchet mechanism;

means for coupling the direction control element to the tool release actuator to impede inadvertent operation of the tool release mechanism when the direction control element is in at least a selected one of said positions.

16. The invention of claim 15 wherein the plurality of positions comprise a forward position, in which the direction control element controls the ratchet mechanism to transfer forward rotation of the handle to the drive stud while allowing reverse rotation of the handle with respect to the drive stud; a reverse position, in which the direction control element controls the ratchet mechanism to transfer reverse rotation of the handle to the drive stud while allowing forward rotation of the handle with respect to the drive stud; and a non-ratcheting position, in which the direction control element controls the ratchet mechanism to allow forward and reverse rotation of the drive stud in the handle.

17. The invention of claim 16 wherein the coupling means impedes inadvertent operation of the tool release mechanism both when the direction control element is in the forward position and when the direction control element is in the reverse position.

18. The invention of claim 16 wherein the coupling means allows operation of the tool release mechanism when the direction control element is the non-ratcheting position.

19. The invention of claim 16 wherein the coupling means allows operation of the tool release mechanism only when the direction control element is the non-ratcheting position.

20. The invention of claim 15 wherein the coupling means comprises a first protruding element coupled with the direction control element and a second protruding element coupled with the tool release actuator, wherein the first and second protruding elements are mechanically interlocked when the direction control element is in at least one of said positions to impede inadvertent operation of the tool release mechanism.

21. The invention of claim 17 wherein the coupling means comprises a first protruding element coupled with the direction control element and a second protruding element coupled with the tool release actuator, and wherein the first and second protruding elements are mechanically interlocked both when the direction control element is in the forward position and when the direction control element is in the reverse position.

22. The invention of claim 17 wherein the coupling means comprises a first protruding element coupled with the direction control element and a second protruding element coupled with the tool release actuator, and wherein the first and second protruding elements are mechanically disengaged when the direction control element is in the non-ratcheting position.

23. The invention of claim 17 wherein the coupling means comprises a first protruding element coupled with the direction control element and a second protruding element coupled with the tool release actuator, and wherein the first and second protruding elements are mechanically disengaged only when the direction control element is in the non-ratcheting position.

24. The invention of claim 20, 21, 22 or 23 wherein the first protruding element is mounted internally of the ratchet wrench.

25. The invention of claim 16, 17, 18, 19, 21, 22 or 23 further comprising a detent mechanism tending to retain the direction control element in the non-ratcheting position.

26. The invention of claim 1 or 15 wherein the tool release actuator comprises first and second relatively movable elements, wherein the tool retention element engages the first element, and wherein the direction control element is coupled to the second element.

27. The invention of claim 26 wherein the first element remains movable even when the direction control element is coupled to the second element.

28. The invention of claim 26 wherein the first element comprises a control rod and wherein the second element comprises a button.

29. The invention of claim 6 or 10 wherein the tool release actuator comprises a recess adjacent the second protruding element, said recess sized to receive the first protruding element.

30. In a ratchet wrench of the type comprising: a handle, a drive stud rotatably mounted in the handle, and a ratchet mechanism coupled to the drive stud, the improvement comprising:

a tool release mechanism comprising a tool retention element disposed in the drive stud and a tool release actuator coupled to the tool retention element, said tool release actuator comprising a recess formed therein;

a direction control element coupled to the ratchet mechanism and movable to forward, non-ratcheting, and reverse positions to select a forward ratchet direction, a non-ratcheting action, and a reverse ratchet direction, respectively, for the ratchet mechanism; and a protruding element coupled with the direction control element and shaped to fit into the recess when the direction control element is in the forward position, to remain outside the recess when the direction control element is in the non-ratcheting position, and to fit into the recess when the direction control element is in the reverse position, said protruding element impeding inadvertent operation of the tool release mechanism when the direction control mechanism is in both of the forward and reverse positions.

31. The invention of claim 30 further comprising a detent mechanism tending to retain the direction control element in the non-ratcheting position.

32. The invention of claim 30 wherein the tool release actuator comprises first and second relatively movable elements, wherein the tool retention element engages the first element, and wherein the recess is formed in the second element.

33. The invention of claim 32 wherein the first element remains movable even when the protruding element is fit into the recess.

34. The invention of claim 32 wherein the first element comprises a control rod and wherein the second element comprises a button.

35. The invention of claim 30 wherein the protruding element is mounted internally of the ratchet wrench.

36. The invention of claim 30 wherein the direction control element comprises first and second relatively movable parts.

37. The invention of claim 14 wherein the detent mechanism comprises a detent ball and a recessed surface formed by a pawl included in the ratchet mechanism.

38. The invention of claim 25 wherein the detent mechanism comprises a detent ball and a recessed surface formed by a pawl included in the ratchet mechanism.

39. The invention of claim 31 wherein the detent mechanism comprises a detent ball and a recessed surface formed by a pawl included in the ratchet mechanism.

40. The invention of claim 1, 15 or 30 wherein the ratchet mechanism comprises a ratchet wheel coupled to the drive stud, said ratchet wheel comprising a face on a side of the ratchet wheel opposite the drive stud, and a first recess formed in the face; wherein the wrench comprises a second recess shaped to receive the ratchet wheel for rotation about an axis, and a centering element protruding into the first recess, and wherein the centering element acts to center the first face about the axis.

41. The invention of claim 40 wherein the centering element is interrupted at a gap, and wherein a portion of the direction control element is movable into the gap.

42. In a ratchet wrench of the type comprising: a handle, a drive stud rotatably mounted in the handle, and a ratchet mechanism coupled to the drive stud, the improvement comprising:

a direction control element coupled to the ratchet mechanism and movable to a plurality of positions to select respective ratchet directions for the ratchet mechanism;

said plurality of positions comprising a forward position, in which the direction control element controls the ratchet mechanism to transfer forward rotation of the handle to the drive stud while allowing reverse rotation of the handle with respect to the drive stud; a reverse position, in which the direction control element controls the ratchet mechanism to transfer reverse rotation of the handle to the drive stud while allowing forward rotation of the handle with respect to the drive stud; and a non-ratcheting position, in which the direction control element controls the ratchet mechanism to allow forward and reverse rotation of the drive stud in the handle;

said direction control element being in stable equilibrium in the non-ratcheting position;

a tool release mechanism comprising a tool retention element disposed in the drive stud and a tool release actuator coupled to the tool retention element;

wherein the direction control element is coupled to the tool release mechanism to impede inadvertent operation of the tool release mechanism when the direction control element is in at least a selected one of the positions.

43. The invention of claim 42 wherein the selected one of the positions is a ratcheting position.

44. The invention of claim 1 wherein the direction control element is coupled to the tool release actuator internally of the wrench handle.

* * * * *

UNITED STATES PATENT AND TRADEMARK OFFICE

CERTIFICATE OF CORRECTION

PATENT NO. : 6,044,730
DATED : April 4, 2000
INVENTOR(S) : Peter M. Roberts et al.

It is certified that error appears in the above-identified patent and that said Letters Patent is hereby corrected as shown below:

Title page,
After item [58],please insert a new item as follows:

-- References Cited
U.S. PATENT DOCUMENTS

| | | |
|---|---|---|
| 3,208,318 | 04/1964 | Roberts |
| 4,300,413 | 11/1981 | Garofalo |
| 4,420,995 | 12/1983 | Roberts |
| 4,699,028 | 10/1987 | Bosque |
| 4,848,196 | 07/1989 | Roberts |
| 5,178,047 | 01/1993 | Arnold et al. |
| 5,386,747 | 02/1995 | Grover |
| 5,503,048 | 04/1996 | Moon --. |

Claim 18,
Line 3, please change "is the" to -- is in the --.

Claim 19,
Line 3, please change "is the" to -- is in the --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*